United States Patent [19]

Greenway

[11] Patent Number: 4,499,637

[45] Date of Patent: Feb. 19, 1985

[54] METHOD FOR THE PRODUCTION OF MATERIALS HAVING VISUAL SURFACE EFFECTS

[75] Inventor: John M. Greenway, Spartanburg, S.C.

[73] Assignee: Milliken Research Corporation, Spartanburg, S.C.

[21] Appl. No.: 103,329

[22] Filed: Dec. 14, 1979

[51] Int. Cl.[3] ..... D06C 23/00

[52] U.S. Cl. ..... 26/2 R; 28/160; 28/163

[58] Field of Search ..... 26/2 R; 28/160, 163; 68/205 R

[56] References Cited

U.S. PATENT DOCUMENTS

| | | | |
|---|---|---|---|
| 2,241,222 | 5/1941 | Sonnino | 26/2 R |
| 2,373,194 | 4/1945 | Luttge . | |
| 2,563,259 | 8/1951 | Miller | 26/2 R X |
| 2,875,504 | 3/1959 | White . | |
| 2,988,800 | 6/1961 | White . | |
| 3,010,179 | 11/1961 | Thal | 26/2 R X |
| 3,256,581 | 6/1966 | Thal et al. | 26/2 R |
| 3,443,878 | 5/1969 | Weber et al. | 28/163 X |
| 3,613,186 | 10/1971 | Mazzone et al. | 26/2 R |
| 3,721,517 | 3/1973 | Osthoff . | |
| 3,729,784 | 5/1973 | Mazzone et al. | 26/2 R |
| 3,774,272 | 11/1973 | Rubaschek et al. | 26/2 R |
| 3,842,468 | 10/1974 | Harrison | 28/248 |
| 3,856,598 | 12/1974 | Gregorian et al. . | |
| 3,916,823 | 11/1975 | Halloran | 26/2 R X |
| 3,969,779 | 7/1976 | Stewart, Jr. | 68/205 R |
| 4,323,760 | 4/1982 | Greenway et al. | 26/2 R X |

FOREIGN PATENT DOCUMENTS

| | | | |
|---|---|---|---|
| 766310 | 9/1971 | Belgium | 26/2 R |
| 653805 | 12/1962 | Canada | 28/160 |
| 46-39959 | 11/1971 | Japan | 26/2 R |
| WO79/00926 | 11/1979 | PCT Int'l Appl. | 26/2 R |
| 275696 | 8/1927 | United Kingdom . | |
| 952819 | 3/1964 | United Kingdom . | |
| 978452 | 12/1964 | United Kingdom . | |
| 1028441 | 5/1966 | United Kingdom . | |
| 1063252 | 3/1967 | United Kingdom . | |
| 1101899 | 1/1968 | United Kingdom . | |
| 1171543 | 11/1969 | United Kingdom . | |
| 1172289 | 11/1969 | United Kingdom . | |
| 1341114 | 12/1973 | United Kingdom . | |
| 1380071 | 1/1975 | United Kingdom . | |
| 2088424 | 6/1982 | United Kingdom . | |

*Primary Examiner*—Robert Mackey

*Attorney, Agent, or Firm*—George M. Fisher; H. William Petry

[57] ABSTRACT

Method for pressurized fluid stream treatment of the surface of a relatively moving substrate to impart visual surface changes thereto. A fluid discharge manifold having an elongate discharge slot disposed across the path of relative movement of the substrate discharges pressurized fluid, such as air, in one or more narrow discrete streams into the surface of a substrate, such as a textile fabric. In one embodiment, a plurality of spaced air outlets are disposed in the discharge slot of the manifold and pressurized cooler air is selectively directed through the outlets and across the slot in accordance with pattern information to block heated air streams from exiting from the discharge slot in selected locations and thus pattern the surface of a substrate comprised of thermoplastic yarns. The slot of the discharge manifold also may be provided with an elongate shim member having a plurality of spaced notches in a side edge of the shim member. The shim member is disposed with its notches in the discharge slot to provide corresponding spaced channels for discharge of the fluid in streams onto the substrate surface. The shim member may be employed alone in the manifold slot to pattern the moving substrate, or it may be employed in combination with the cooler air blocking outlets to provide more intricate patterning of the substrate.

20 Claims, 15 Drawing Figures

METHOD FOR THE PRODUCTION OF MATERIALS HAVING VISUAL SURFACE EFFECTS

This invention relates to improved method and apparatus for pressurized fluid stream treatment of relatively moving materials to provide visual surface effects therein, as well as to novel products produced thereby.

As used herein, the term "fluid" includes gaseous, liquid, and solid fluent materials which may be directed in a cohesive pressurized stream or streams against the surface of a substrate material. The term "gas" includes air, steam, and other gaseous or vaporous media, or mixtures thereof, which may be directed in a cohesive pressurized stream or streams. The term "substrate" is intended to define any material, the surface of which may be contacted by a pressurized stream or streams of fluid to impart a change in the visual appearance thereof.

Although substrates particularly suited for pressurized fluid stream treatment with the apparatus of the present invention are textile fabric constructions, and, more particularly, textile fabrics containing thermoplastic yarn and/or fiber components wherein pressurized heated fluid stream treatment of the surface of the fabric causes thermal modification of the yarns or fibers to produce a desired surface effect or pattern therein, the apparatus may be employed to treat any substrate wherein the nature of the pressurized treating fluid stream or substrate causes a visual change in the surface of the substrate due to contact by the stream. For example, the treating fluid may be a solvent for the substrate material, or the temperature of the fluid may be such as to thermally modify or deform the components of the substrate contacted by the fluid streams to produce such effects.

As used herein, the term textile fabric is intended to include all types of continuous or discontinuous webs or sheets containing fiber or yarn components, such as knitted, woven, tufted, flocked, laminated, or non-woven fabric constructions, in which pressurized heated fluids may impart a change in the visual surface appearance of the fabric.

BACKGROUND OF THE INVENTION

It is known to impart a surface pattern to certain acrylic pile fabrics by roll embossing, wherein the pile surface is brought into engagement with raised surfaces of the roll to press heated pile fibers into the backing of the fabric and transfer the roll surface pattern into the fabric surface. However, such roll embossing of heated pile fabric products is quite expensive because a different pattern roll is required for each different pattern to be applied to the fabric, and the length of a pattern repeat in the fabric is limited by the circumference of the pattern roll. In addition, it is believed that the patterns produced in acrylic pile fabrics by embossing cannot generally be obtained by roll embossing melt spun thermoplastic yarn fabrics, such as nylon and polyester pile fabrics, due to the difficulty of obtaining the high temperatures required to sufficiently shrink and heat-set the yarns, and the resultant tendency for sticking of the yarns to the embossing roll.

It is known in the dyeing of fabrics to pattern dye a moving fabric by the use of continuously flowing liquid streams of dyestuff which are selectively deflected away from striking the fabric by intersecting streams of air controlled in accordance with pattern information. U.S. Pat. No. 3,969,779 and U.S. Pat. No. 4,059,880 disclose apparatus used for such purpose.

It is generally known to employ apparatus to direct pressurized air or steam into the surface of textile fabrics to alter the location of or modify the thermal properties of fibers or yarns therein to provide a change in the surface appearance of such fabrics. U.S. Pat. No. 3,010,179 discloses apparatus for treating synthetic pile fabrics by directing a plurality of jets of dry steam from headers onto the face of the moving fabric to deflect and deorient the pile fibers in areas contacted by the steam, and the fabric is thereafter dried and heated to heat-set the deflected fibers and provide a visual effect simulating fur pelts. U.S. Pat. No. 2,563,259 discloses a method of patterning a flocked pile fabric by directing plural streams of air into the flocked surface of the fabric, before final curing of the adhesive in which the fibers are embedded, to reorient the pile fibers and produce certain patterns therein. U.S. Pat. No. 3,585,098 discloses aparatus for hot air or dry steam treatment of the pile surface of a fabric to relax stresses in the synthetic fibers and cause a disorientation and curling of the fibers throughout the fabric. U.S. Pat. No. 2,241,222 discloses apparatus having a plurality of jet orifices for directing pressurized air or steam perpendicularly into a fluffy fabric surface to raise and curl the nap or fluff of the fabric. U.S. Pat. No. 2,110,118 discloses a manifold having a narrow slot for directing pressurized air against the surface of a fabric containing groups of tufts to fluff the tufts during a textile treating operation.

Although the patents mentioned in the preceding paragraph indicate generally that pressurized air and steam may be employed to alter the surface appearance of fabrics, it is believed that such prior art devices do not possess sufficient accuracy and precision of control of high temperature gas streams to obtain highly precise and intricate surface patterns with well defined boundaries, but generally can only be used to produce relatively grossly defined surface patterns, or surface fiber modifications or a random, non-defined nature. In addition, the apparatus appear to be limited as to the variety of different patterns that can be produced in the fabrics therewith.

In modifying the surface appearance of a relatively moving substrate, such as a textile fabric, by application of streams of fluid, many difficulties are encountered in controlling the flow, pressure, and direction of the streams with sufficient reliability and accuracy to impart precisely defined and intricate patterns to the textile fabric. In addition to preciseness of pattern definition, difficulties are presented in effectively handling very high temperature fluids while maintaining a uniform temperature in the fluid streams across the width of a moving fabric, as well as in controlling rapid activation and deactivation of heated streams by conventional valves located in the heated fluid flow lines. Also, contaminants in the heated fluid can easily block and clog small individual jet orifices of a pressurized fluid applicator, resulting in down time of the treating apparatus to clear the blockage, and loss of fabric product due to improper patterning by the apparatus during such blockage.

OBJECTS OF THE INVENTION

It is therefore an object of the present invention to provide method and apparatus for more reliable and precise surface patterning of substrate materials with pressurized fluid streams than heretofore believed obtained by prior apparatus and methods.

It is another object of the invention to provide improved method and apparatus for the pressurized, high temperature fluid stream treatment of the surface of substrate materials containing thermoplastic components to impart a change in the surface appearance thereof.

It is a more specific object to provide improved method and apparatus for directing precisely defined streams of a high temperature, pressurized gas into the surface of a textile fabric containing thermoplastic yarns to thermally modify the thermoplastic yarns in the fabrics and produce a desired surface pattern therein.

It is another object to provide improved method and apparatus for treating pile fabrics containing thermoplastic pile yarns with selectively directed streams of heated gas to longitudinally shrink the yarns and produce a precisely defined surface pattern therein.

It is a further object to provide improved method and apparatus for treating textile woven fabrics containing thermoplastic fiber or yarn components with selectively directed streams of heated gas to provide a novel patterned crepe or blister effect in the fabrics.

It is another object to provide method and apparatus for uniformly raising the pile yarns of a pile fabric having a predominantly uni-directional pile yarn lay in the fabric.

It is a further more specific object to provide improved method and apparatus for directing one or more narrow streams of high temperature gas generally perpendicularly into the surface of a textile fabric to thermally alter the characteristics of thermoplastic fibers and yarns therein, while selectively blocking passage of the streams or portions thereof with cooler pressurized gas streams in accordance with pattern information to impart various surface patterns thereto.

It is another object to provide certain novel fabric products produced by the method and apparatus of the present invention.

BRIEF DESCRIPTION OF THE DRAWINGS

The above as well as other objects of the invention will become more apparent from the following detailed description of preferred embodiments of the invention, when taken together with the accompanying drawings, in which.

BRIEF DESCRIPTION OF THE INVENTION

Figure 1:
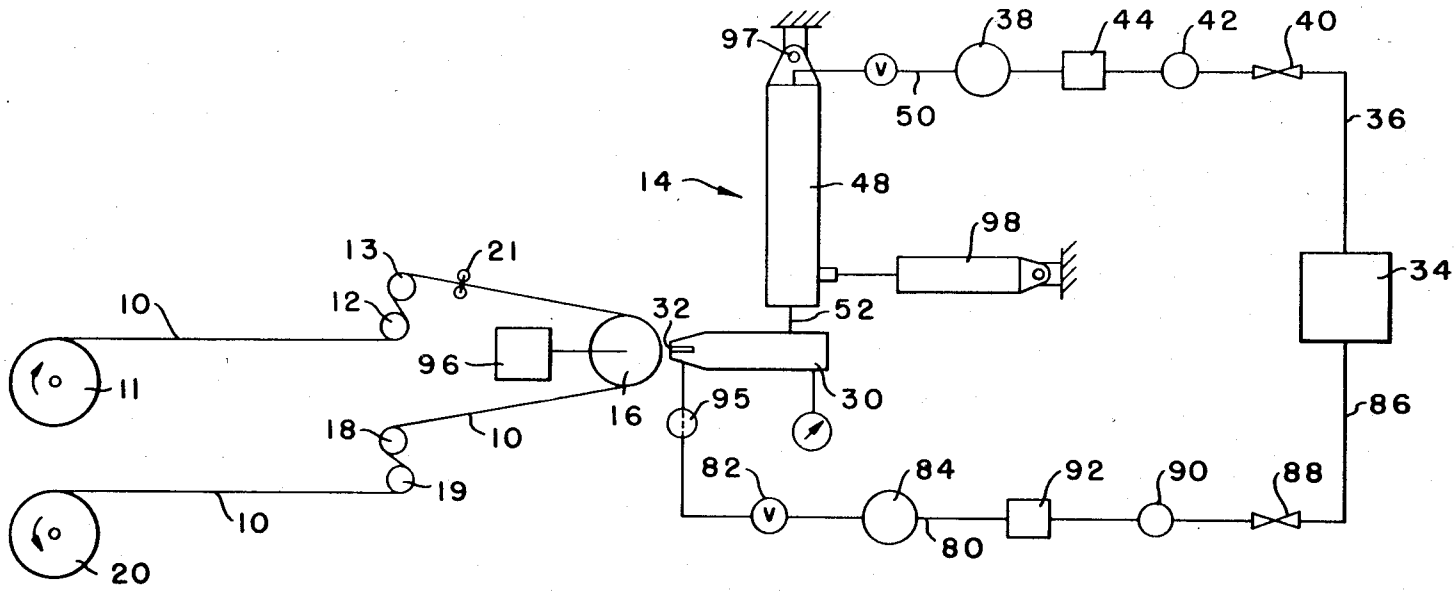
FIG. 1 is a diagrammatic, overall, side elevation view representation of apparatus for imparting visual surface effects in a moving substrate in accordance with the present invention.

In its broad aspects, the present invention comprises improved method and apparatus for the accurate and high speed application of a pressurized stream or streams of pressurized fluid to the surface of a relatively moving substrate to impart a change in the visual surface appearance therein. More particularly, the apparatus includes a heated fluid distributing manifold having a narrow elongate slot disposed across the path of relative movement of the substrate and located closely adjacent the surface to be treated. Pressurized fluid, such as air, under high temperatures, e.g., 300°–700° F., is supplied to the manifold and directed from the slot generally perpendicularly into the surface of the moving substrate, while the discharge of the hot air from the slot is controlled to direct the same in one or more narrow, precisely defined streams which impinge upon the substrate surface to impart a desired surface change therein. The heated air striking the substrate, in the case of substrates comprising textile fabrics containing thermoplastic yarns or fibers, causes thermal modification of the thermoplastic fibers and yarn components in the fabric to alter the physical appearance thereof, longitudinally shrinking the fibers and yarns in selected areas to form patterns having precisely defined boundaries.

In one embodiment of the invention, heated fluid, such as air, is selectively directed into precisely defined streams by the use of an elongate shim member having notches selectively spaced along an edge of the shim member, with the notched edge of the shim member disposed in the manifold slot along its length to define spaced channels for directing the air into narrow plural streams onto the surface of the relatively moving substrate. The shim member is further constructed to provide for filtration of foreign particles from the air to prevent clogging of the channels while maintaining continued flow of the air streams therethrough.

In a further embodiment, the treating apparatus includes means for selectively directing pressurized, relatively cooler gas streams transversely across the manifold slot at spaced locations therealong to effectively block the passage of hot air from striking the substrate in such locations, in accordance with pattern control information. The pressurized cool gas discharge means include suitable valves for individually controlling the flow of each of the blocking streams of cool gas, such as air, and the cooler gas blocking means may be employed in the manifold slot with or without the aforementioned shim members to selectively pattern the substrate surface in accordance with pattern information.

The invention further includes fluid handling means for maintaining uniform distribution of the heated fluid across the full length of the manifold and manifold slot, thus ensuring more accurate and precise heat patterning of the substrate thereby.

The high temperature fluid treatment method and apparatus of the present invention is particularly suited to produce novel surface patterns of highly precise boundary definition in pile fabrics containing melt-spun thermoplastic pile yarns, which patterns are not heretofore believed to have been produceable with heated fluid treatment apparatus of the prior art. Surface patterns may also be imparted to pile fabrics containing non-thermoplastic type yarn components, such as rayon or acrylic yarns, although the definition obtained in the patterns generally does not appear as precisely defined as in the patterning of thermoplastic yarn-containing fabrics. Further, the method and apparatus may be employed to selectively treat woven fabrics containing thermoplastic yarns to provide novel crepe or blister-type patterns in such fabrics.

The invention further includes a method for uniformly raising the pile yarns of a pile fabric having an initial uni-directional pile yarn inclination by application of a heated gas stream into the pile surface while relatively moving the fabric in a direction generally opposite to the direction of inclination of the pile yarns.

Although the apparatus of the present invention is particularly adapted to treatment of textile fabrics containing theremoplastic fiber and yarn components to provide various visual surface effects therein, it is contemplated that the apparatus may be used in fluid treatment of other substrate materials containing thermoplastic components to thermally alter their visual appearance or provide a desired pattern therein.

DETAILED DESCRIPTION OF EMBODIMENTS OF THE INVENTION

Referring more particularly to the drawings, which illustrate preferred embodiments of apparatus as well as certain novel fabric products of the present invention, FIG. 1 is a schematic side elevation view of the overall treating apparatus of the present invention. As shown diagrammatically, an indefinite length substrate material, such as a textile fabric 10, is continuously directed from a supply source, such as roll 11, by means of driven, variable speed feed rolls 12, 13 to a pressurized heated fluid treatment device, indicated generally at 14. The moving fabric 10 is supported during application of heated fluid thereto by passage about a support roll 16, and the fluid treated fabric is thereafter directed by driven, variable speed take-off rolls 18, 19 to a fabric collection roll 20.

A conventional fabric edge-guiding device 21, well known in the art, may be provided in the fabric path between feed rolls 12, 13 and the fluid treating device 14 to maintain proper lateral alignment of the fabric during its passage over support roll 16. The speed of the feed rolls 12, 13 support roll 16, and take-off rolls 18, 19 may be controlled, in known manner, to provide the desired speed of fabric travel and the desired tensions in the fabric entering, passing through, and leaving the fluid treating device 14.

Figure 2:
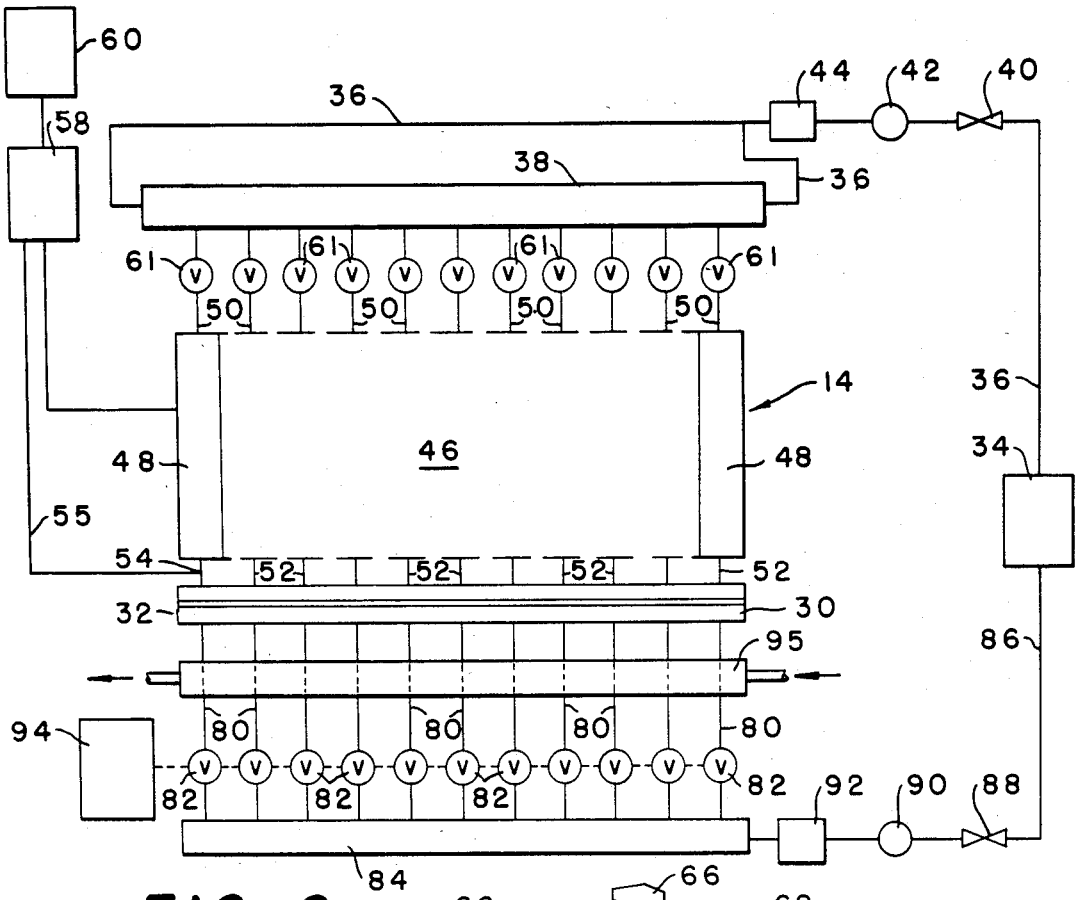
FIG. 2 is an enlarged diagrammatic front elevation view of the pressurized heated fluid applicator section of the apparatus of FIG. 1, illustrating an arrangement of the component parts thereof for supplying both heated and relatively cool pressurized gas to a hot gas distributing manifold of the applicator.

As illustrated in FIGS. 1 and 2, pressurized fluid treating device 14 includes an elongate heated gas discharge manifold 30 which extends perpendicularly across the path of movement of fabric 10 and has a narrow, elongate discharge slot 32 for directing a stream of pressurized heated gas, such as air, into the surface of the fabric and at an angle generally perpendicular to the surface during its movement over support roll 16.

Pressurized gas, such as air, is supplied to the interior of the discharge manifold 30 by means of an air compressor 34 which is connected by air conduit line 36 to opposite ends of an elongate cool air manifold, or header pipe, 38. Located in the air conduit line 36 to control the flow and pressure of air to manifold 38 is a master control valve 40, and an air pressure regulator valve 42. A suitable air filter 44 is also provided to assist in removing contaminants from the air passing into cool air manifold 38.

Pressurized air in the cool air manifold 38 is directed from manifold 38 to hot air discharge manifold 30 through a bank 46 of individual electric heaters, only two of which, 48, are illustrated in FIG. 2. Each heater is connected by inlet and outlet conduits 50, 52 respectively, positioned in uniformly spaced relation along the lengths of the two manifolds 38, 30 to heat and distribute the air from manifold 38 uniformly along the full length of the discharge manifold 30. The bank of heaters 48 may be enclosed in a suitable insulated housing and the air outlet conduit 52 of each heater is provided with a temperature sensing device, such as a thermocouple, the position of one of which, 54, is shown in FIG. 2, to measure the temperature of the outflowing air. The thermocouples are electrically connected by wiring (illustrated by line 55 in FIG. 2) to a conventional electrical recorder/controller 58 where the temperatures can be observed, monitored, and electric current supplied as required to individual of the heaters from a power source, generally indicated at 60, to maintain the outlet air temperatures from the heaters uniform across the discharge manifold 30. Such electrical recorder/controllers are believed to be well known and readily available in the art, and details thereof are not described herein.

To simplify the maintenance of uniform temperature of the air exiting fronm each of the outlet conduits 52 of each of the heaters 48, and to eliminate the necessity and expense of individually monitoring and regulating the electrical power to each heater 48 in the heater bank 46, the pressurized air inlet conduit 50 to each heater may be provided with a needle control valve 61 which may be manually adjusted to individually and precisely control the amount of air supplied to each electrical heater from cool air manifold 38. By the use of such needle valves, electrical power may be uniformly supplied to all of the heaters in the bank, and any initial variations in the outlet air temperatures from the heaters "balanced" to uniformity by incremental adjustment of the needle valves. Thereafter, the temperature in the outlet conduit of only one of the heaters, or at one location in the heated air manifold, need be monitored to regulate electrical power supply to the entire bank of the heaters, in mass. The provision and use of the individual needle valves to vary the flow of pressurized gas through the individual heater units to initially balance exit air temperatures from the heaters is not my independent invention, but is a preferred embodiment which forms the subject matter of a joint invention described and claimed in commonly assigned U.S. Pat. No. 4,323,760 to Greenway and Bylund.

Figure 3:
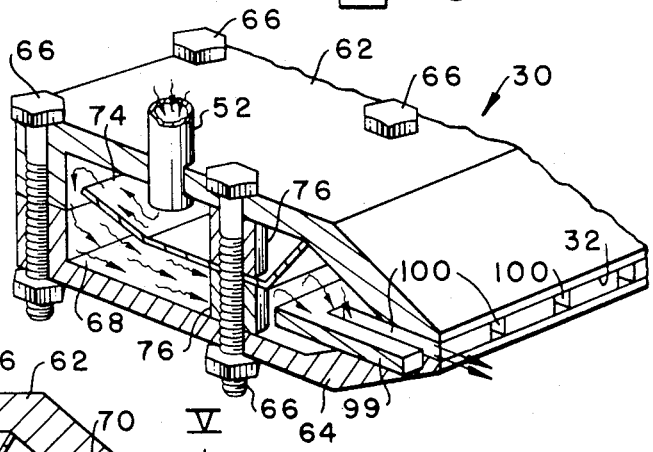
FIG. 3 is an enlarged schematic perspective view of a portion of the hot gas distributing manifold of FIGS. 1 and 2, with portions broken away and shown in section to illustrate certain of the interior components and a shim member employed in the elongate slot of the manifold to impart a desired surface pattern to the relatively moving substrate.
Figure 4:
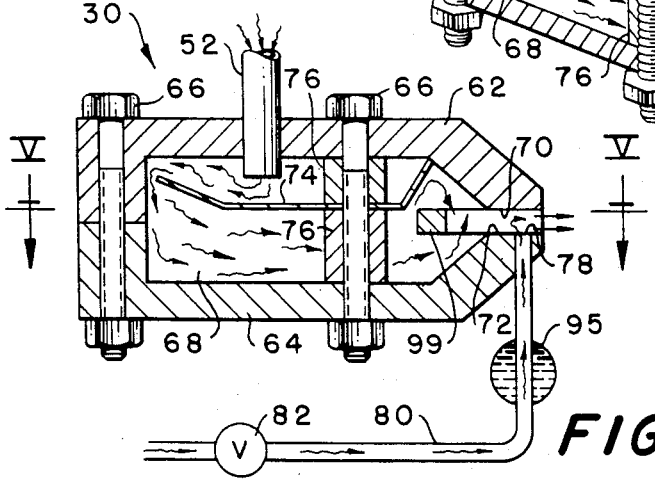
FIG. 4 is a schematic sectional elevation view of the heated gas distributing manifold of FIG. 3; and additionally showing the use of pressurized cooler gas distribution means for selectively blocking portions of the heated gas from exiting from the manifold to produce a patterned appearance in the substrate.
Figure 6:
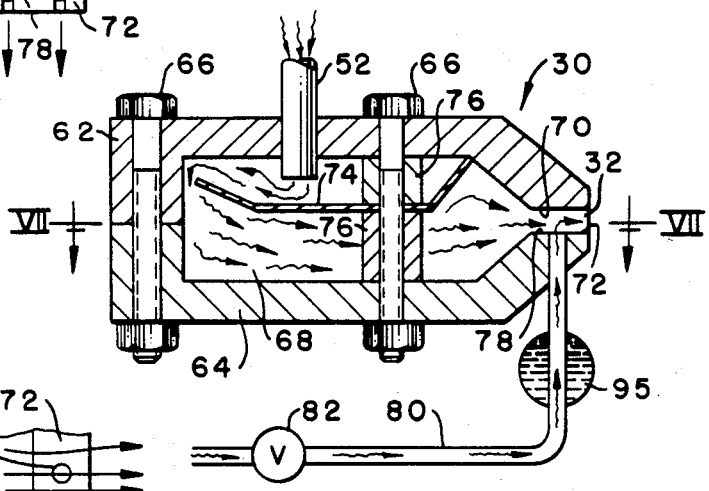
FIG. 6 is a schematic sectional elevation view of a modified form of the hot gas manifold, with shim member removed from the hot gas distributing slot of the manifold and with only the cooler gas distributing means employed to control the hot gas discharge from the slot.

As best seen in FIGS. 3, 4 and 6, heated air discharge manifold 30 is formed of upper and lower wall sections 62, 64 which are removably secured together by suitable fastening means, such as spaced bolts 66, to form the interior compartment 68 of the manifold as well as opposed parallel walls 70, 72 of the elongate discharge slot 32.

Prior to discharge through slot 32, heated air passing into the compartment 68 of manifold 30 from the outlet conduits 52 of the bank of heaters 48 is directed rearwardly and then forwardly in a reversing path through the manifold compartment (as indicated by the arrows) by means of a baffle plate 74 which forms a narrow elongate opening rearwardly in compartment 68 for passage of the air from the upper to the lower portion of the compartment. Baffle plate 74 thus provides for more uniform distribution of the air in the manifold compartment and further facilitates the maintenance of uniform air temperature and pressure in the manifold. Baffle plate 74 is supported in manifold compartment 68 by spacer sleeves 76 surrounding bolts 66.

As best seen in FIGS. 4–7, located in the wall surface 72 or lower wall section 64 of the manifold and positioned in spaced relation along the length of the discharge slot are a plurality of cool air discharge outlets 78. Each outlet is individually connected by a suitable flexible conduit 80 and solenoid valve 82 to a cool air manifold 84, which is in turn connected to air compressor 34 by conduit 86 (FIG. 2). Located in conduit 86 is a master control valve 88, air pressure regulator valve 90, and air filter 92.

As diagrammatically illustrated in FIG. 2, each of the individual solenoid valves is electrically operatively connected to a suitable pattern control device 94 which sends electrical impulses to open and close selected of the solenoid valves in accordance with predetermined pattern information. Various conventional pattern control devices well known in the art may be employed to activate and deactivate the valves in desired sequence. Typically, the pattern control device may be of a type described in commonly assigned U.S. Pat. No. 3,894,413.

As illustrated in FIGS. 4 and 6, each of the cool air discharge outlets 78 is located in the lower wall surface 72 of the manifold slot 32 to direct a pressurized discrete stream of relatively cool air transversely across the heated air discharge slot in a direction perpendicular to the passage of heated air therethrough. The pressure of the cooler air streams is maintained at a level sufficient to effectively block and stop the passage of heated air through the slot in the portion or portions into which the cold air streams are discharged. Thus, by activation and deactivation of the individual streams of cool air by the solenoid valves 82 in accordance with information from pattern control device 94, pressurized heated air passing through the slot will be directed in one or more distinct streams to strike the moving fabric surface in a desired location, thus providing a pattern effect in the surface of the fabric 10 as it passes the discharge manifold. The cooler air which blocks the passage of the heated air passes out of the slot in place of the heated air to dissipate around or into the fabric surface without altering the thermal characteristics of the fabric or appreciably disturbing the yarns or fibers therein. Note the arrows indicating air flow in FIGS. 4, 6, and 7. To ensure that the cooler blocking air is maintained sufficiently cool so as not to effect or thermally modify the fabric, the ambient air may be additionally cooled prior to discharge across the manifold slot 32 by provision of a cool water header pipe 95 through which the cool air conduits 80 pass.

Although cool pressurized air blocking means, as specifically described herein, is preferred for controlling discharge of the heated pressurized gas streams, it is contemplated that other type blocking means, such as movable baffles, or the like, may be employed in the elongate slot 32 to selectively prevent passage of the heated pressurized air into the fabric.

To prevent possible bowing or warping of the fabric support roll 16 due to differential heating of its circumference by contact of one side of the roll by the high temperature gas from the manifold discharge slot 32, the interior of the roll 16 may be provided with a circulating heat transfer fluid, such as water, from a supply source 96. The circulating fluid thus facilitates uniform heat transfer about the circumference, particularly when the fabric feed is momentarily stopped. The provision of such heat transfer fluid in roll 16 is not my sole independent invention, but forms subject matter of the invention of aforesaid Greenway and Bylund U.S. Pat. No. 4,323,760.

To avoid damage to the fabric by the presence of heated gas when the fabric feed is stopped, the hot gas manifold 30 and its heaters 48 are pivotally supported, as at 97, and fluid piston means 98 utilized to pivot the manifold and its discharge slot away from the path of fabric 10.

FIG. 3 illustrates a first form or embodiment of the heated pressurized gas discharge manifold of the present invention wherein an elongate shim member or plate 99 having a plurality of elongate generally parallel notches 100 uniformly spaced along one edge of the plate is removably positioned in the manifold compartment 68 with its notched side edge extending into the elongate discharge slot 32 to form with the walls 70, 72 of the slot a plurality of corresponding heated air discharge channels for directing narrow discrete streams of pressurized heated gas onto the surface of the moving textile fabric. As seen in FIGS. 3 and 4, the notches 100 of the plate extend into the heated gas manifold compartment 68 to form an elongate inlet above and below the plate into each of the discharge channels formed by the notched edges of the shim and the walls 70, 72 of the manifold slot 32. Thus the shim plate not only serves to direct pressurized gas into narrow streams to be discharged through the spaced channels, but the edges of the shim plate defining the upper and lower openings of the narrow, elongate inlets (note FIG. 4) serve to trap and filter out foreign particles which may be present in the pressurized gas, while permitting continued flow of pressurized gas around the particles and through the channels.

Figure 8:
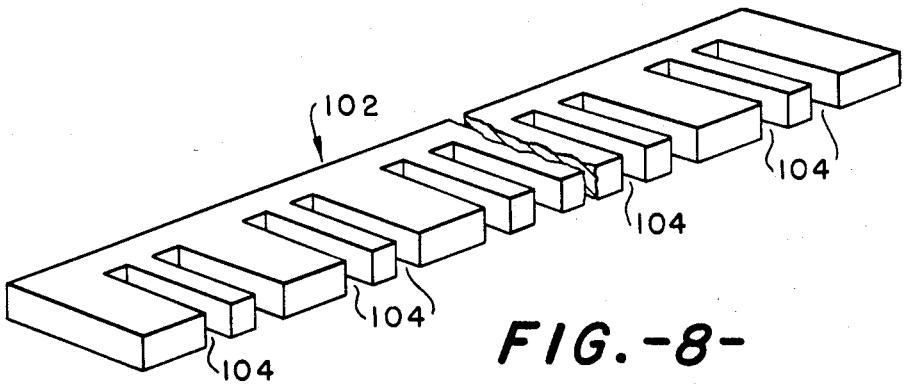
FIG. 8 is an enlarged schematic perspective view of a shim member employed with the hot gas manifold to distribute the gas in narrow spaced streams onto the surface of a substrate.

It can be thus understood that the discharge channels formed by the shim member and discharge slot direct a plurality of discrete, individual spaced streams onto and into the surface of the moving textile fabric to form narrow, spaced generally parallel lines extending in the direction of movement of the fabric past the discharge manifold. By maintaining the temperature and pressure of the heated gaseous streams at a sufficient level, pile fabrics containing thermoplastic pile yarns contacted by the heated gas streams longitudinally shrink, compact in the pile surface, and are heat set to form continuous distinct grooves in the fabric, thereby permitting patterning of the surface of the fabrics in various ways, some of which will be hereinafter described. To change the grooved pattern in the fabric, it is only necessary to loosen the manifold bolts 66 and replace an existing shim plate with another shim plate having a different groove size and/or spacing along the shim plate edge. FIG. 8 illustrates another shim plate 102 having an irregular shim notches 104 spaced non-uniformly along the plate to provide a variation in the pattern which may be applied to the surface of the fabric web. Thus, it can be seen that various surface patterns may be applied to the moving web by the shim plates alone, and without the additional control of the streams by the cooler pressurized gas outlets described above.

Figure 5:
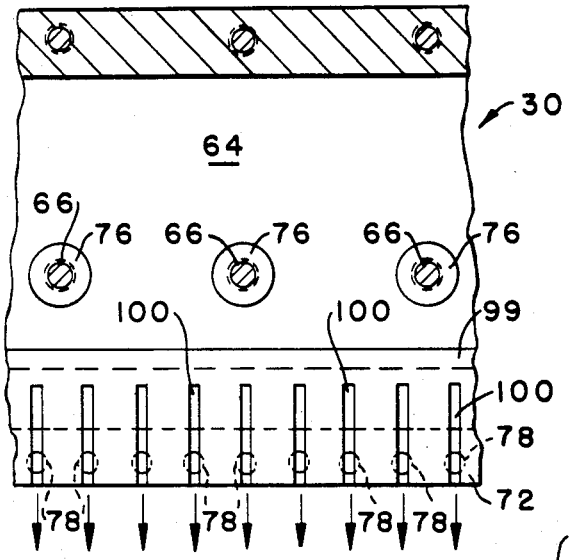
FIG. 5 is a schematic sectional view of a portion of the hot gas distributing manifold shown in FIG. 4, taken generally along line V—V of FIG. 4 and looking in the direction of the arrows.

FIGS. 4 and 5 illustrate a form of the invention wherein shim plates are employed in combination with the pressurized cooler gas outlets in the discharge slot 32 to form more intricate or detailed patterns in the textile web. As seen in FIG. 5, the discharge outlets 78 are located in the channels formed by the shim plate and slot walls 70, 72 to selectively block the channels with cool gas and thereby permit intermittent discharge of selected of the heated gas streams to produce surface patterns which may vary across the fabric as well as in the direction of movement of the fabric past the discharge manifold.

Figure 7:
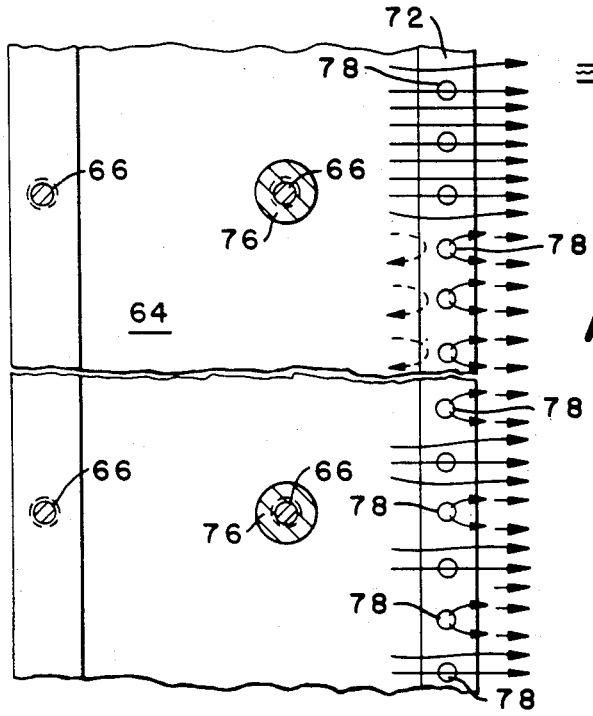
FIG. 7 is a schematic sectional view of portions of the manifold of FIG. 6, taken generally along line VII—VII therein, and looking in the direction of the arrows.

FIGS. 6 and 7 illustrate another form of the invention wherein patterning of the fabric is accomplished by use of the elongate slot 32 and pressurized cool gas outlets without the use of shim plates. As seen in FIG. 7, by selectively activating the cool gas stream supply to certain of the outlets 78 in accordance with pattern information, the heated gas passage through slot 32 is blocked by the cooler gas in corresponding areas of the slot to pattern the moving fabric.

The pressurized heated gas discharge manifold of the present invention also may be employed to uniformly raise the thermoplastic pile yarns of a pile fabric having a generally uniform uni-directional pile lay, such as pile fabrics produced by cutting or slitting of the pile yarns of a double backed knit fabric construction to form two pile fabric sheets. In such a method of pile fabric production, the pile yarns of the two fabric sheets are generally uniformly inclined in a direction opposite the direction of the fabric movement during the cutting operation.

Figure 9:
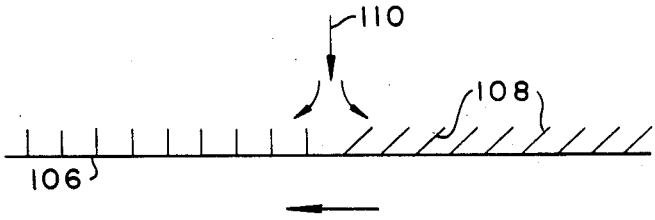
FIGS. 9 and 10 illustrate schematically the method by which the treating apparatus of the invention may be employed to raise the pile of a textile pile fabric substrate having a generally uni-directional pile yarn lay in the fabric.
Figure 10:
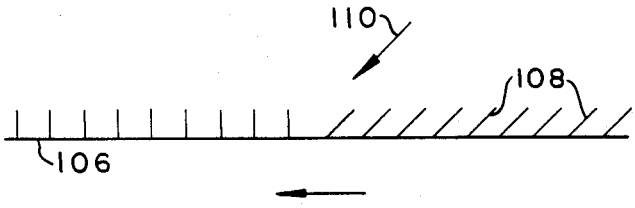

As schematically illustrated in FIG. 9 and 10, it has been found that when a uni-directionally inclined pile fabric is passed by the narrow elongate discharge slot 32 of manifold 30 in a direction of travel opposite to the direction of inclination of the pile yarns, surprisingly, the inclined pile yarns are brought into an upright erect position generally perpendicular to the surface of the pile fabric, and the heated gas stream striking the fabric surface heat sets the pile yarns in such disposition. FIGS. 9 and 10 illustrate the pile fabric substrate 106, the pile yarns 108, their direction of inclination therein, and the direction at which the heated gas stream 110 strikes the pile surface. As illustrated, it is preferable that the gas stream 110, as illustrated by the arrows, strike the fabric surface at an angle of approximately 90° or greater to the direction of fabric movement in order to effect the upright uniform setting of the pile yarns. If the fabric is passed in a direction other than a direction opposite the direction of inclination of its pile yarns, or the pressurized stream of gas is directed other than within the angles mentioned, the pile yarns do not become uniformly erect but are either further inclined or randomly disoriented in the pile fabric surface.

The use of the apparatus of the present invention to carry out certain of the processes described and claimed herein may be further understood by the following specific examples setting forth operating conditions in treatment of textile fabrics containing yarn components to produce a desired surface appearance or pattern therein. The examples are by way of illustration only, and are not intended to be limiting on the use of the apparatus of the present invention.

EXAMPLE 1

A knit polyester plush pile fabric having a weight of thirteen ounces per square yard and a pile yarn height of one tenth of an inch was continuously fed through the apparatus illustrated in FIG. 1 at a speed of fabric travel of five yards per minute. The temperature and pressure of the heated air in the discharge manifold compartment was maintained at 600° F. and 6 p.s.i.g., respectively. The discharge slot of the manifold was maintained at a distance of approximately 0.050 inch from the pile surface and was provided with a shim plate having a notched configuration, as illustrated in FIG. 3. The spaced discharge channels formed in the slot were of rectangular cross-sectional dimension of 0.011 inch by 0.062 inch. The length of each channel through the slot was 0.250 inch and the channels were spaced on 0.2 inch centers across the manifold.

Figure 11:
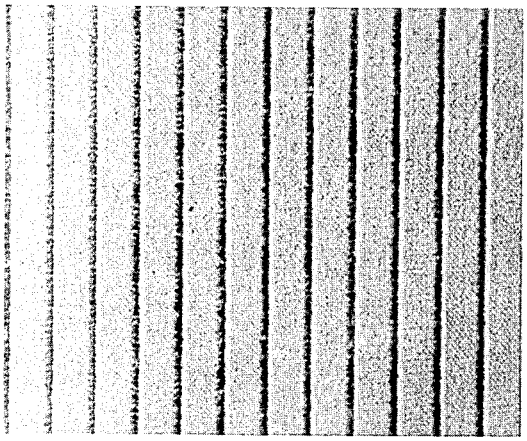
FIGS. 11–15 are photographs of the surface of certain novel textile fabric products treated by and produced in accordance with apparatus and methods of the present invention.

The heated streams of gas striking the pile surface of the fabric caused longitudinal shrinkage of the pile yarns in the areas of contact to lower and compact them into the fabric forming narrow, elongate distinct grooves extending along the path of movement of the surface. Pile yarns adjacent the sides of the grooves remained substantially unmodified and undisturbed to form distinct upright side walls of the grooves. The fabric had a pattern surface appearance as illustrated by the photograph of the fabric in FIG. 11 of the drawings.

EXAMPLE 2

A polyester plain weave fabric having a fabric weight of three and one-half ounces per square yard, and a 92 warp end by 84 picks per inch fabric construction, was processed through the apparatus of FIG. 1 at a fabric speed of four yards per minute and with a 12 percent overfeed of the fabric between rolls 12, 13 and rolls 18, 19. The support roll 16 was overdriven during fabric passage thereover. Heated air temperature and pressure, and discharge channel size and spacing in the manifold was the same as in Example 1.

Figure 12:
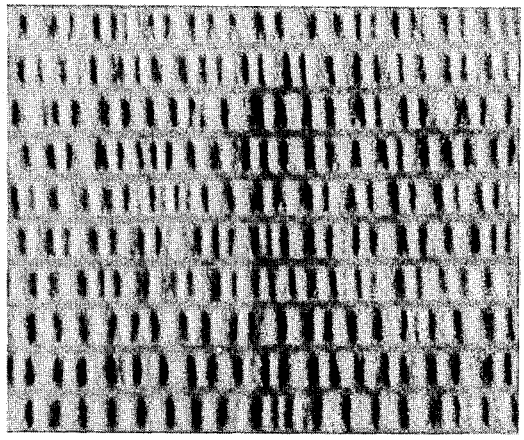

The high temperature pressurized gas streams striking the fabric overfed onto the support roll in warp direction caused longitudinal thermal shrinkage of the warp yarns contacted thereby continuously along their length. Intermediate portions of the fabric between the lines containing yarns which were thermally unshrunk assumed a crepe or pucker appearance, as illustrated by the photograph of the fabric in FIG. 12 of the drawings.

EXAMPLE 3

Figure 13:
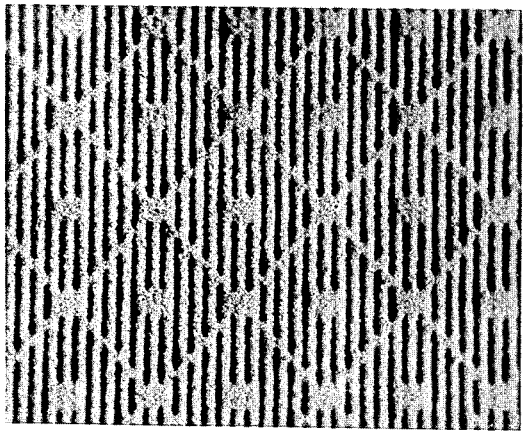

A pile fabric construction as defined in Example 1 was processed through the treating apparatus of FIG. 1 at a process speed of two yards per minute. Heated air temperature in the manifold was maintained at 700° F. and at a pressure of 2 p.s.i.g. Utilizing a fabric speed of two yards per minute, the heated air discharge channels of a shim plate as in Example 1, but spaced at 0.1 inch centers, were selectively blocked by pressurized cooler air streams from the cool air outlets in the manifold slot in accordance with pattern information. A cool air pressure of 12 p.s.i.g. was maintained in the cool air manifold. The treated fabric possessed a pattern composed of a series of narrow distinct, well defined grooves, as illustrated in the photograph of the fabric shown in FIG. 13.

EXAMPLE 4

Figure 14:
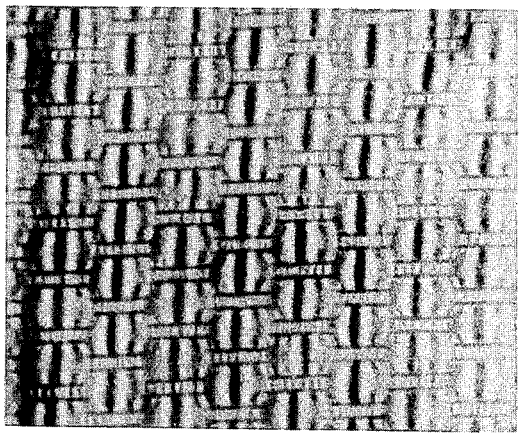
Figure 15:
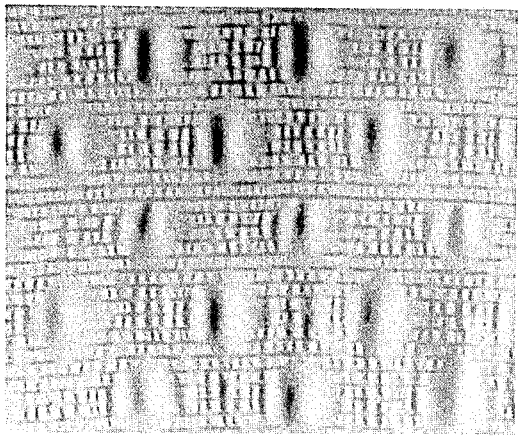

Two polyester woven fabric constructions as described in Example 2 were treated in accordance with the conditions and with cool air pattern control means of Example 3 to cause thermal shrinkage of the warp yarns at spaced locations along the direction of the movement of the fabric. The resultant fabrics, according to pattern information supplied thereto, possessed a pucker and blister appearance, as shown in the respective photographs in FIGS. 14 and 15 of the drawings.

EXAMPLE 5

A plush velvet polyester pile fabric in undyed and unheatset form and having a construction as defined in Example 1 was processed on the apparatus as shown in FIG. 1 at a processing speed of four yards per minute. The pile fabric had a uni-directional pile yarn inclination and was moved past the uninterrupted discharge slot of the hot air manifold in a direction opposite to the direction of inclination of the pile yarns in the fabric, as illustrated in FIGS. 9 and 10. Heated pressurized air at a temperature of 300° F. in the manifold and a pressure of 1½ p.s.i.g. was continuously directed against the moving pile surface at a right angle thereto. The width of the manifold discharge slot was 0.016 inches. The air stream striking the pile surface of the fabric raised the pile to a generally uniform, upright perpendicular position relative to the pile surface and backing of the fabric. The processed fabric exhibited a uniform, upright pile surface appearance.

EXAMPLE 6

A knitted nylon plush pile fabric and a knitted acrylic plush pile fabric, each having a weight of approximately 12 ounces per square yard and a pile height of a 0.1 inch, were each treated on the apparatus of FIG. 1 and under process conditions and with shim plate configuration as described in Example 1. The processed nylon pile fabric exhibited a well defined, distinct pattern of surface grooves with pile yarns which were contacted by the heated air streams being longitudinally shrunken into the backing of the fabric. The acrylic fabric also possessed a grooved surface pattern, but of less distinct appearance and groove definition than the melt spun thermoplastic yarn fabrics, such as the polyester and nylon yarn fabrics of the Examples.

In the foregoing specific Examples, processing speeds of the pile fabric through the apparatus may be increased by preheating the fabric prior to its passage by the heated air discharge manifold slot. Typically, the fabric may be preheated by infrared heaters of known type, and/or by heating support roll 16.

Although the foregoing Examples set forth typical operating conditions for treating textile pile fabrics and woven fabrics to impart visual surface changes and pattern thereto, it can be appreciated that the treating fluid, and the temperatures and conditions of fluid treatment may be varied depending on the particular substrate construction, and the particular surface appearance to be imparted thereto. Excellent results in patterning of pile fabrics containing thermoplastic pile yarns has been achieved at processing speeds of approximately four to six yards per minute, and with heated air temperatures at the heater exits of between 600°-700° F. and pressures of from about two to seven p.s.i.g. in the manifold compartment. In general, higher pressures may be employed when the discharge slot or the channels formed therein are of smaller cross-sectional dimension. Higher gas temperatures may also be desirable when use is made of cool pressurized gas to control the flow of the heated gas streams.

To substantiate the ability to alter and modify various substrate materials by application of pressurized heated fluid streams to selected areas of the substrate surface in accordance with the present invention, a number of substrates of varying constructions and composition were contacted by a stream of pressurized heated air directed thereinto from a fixed single jet orifice having a 0.03 inch diameter. The substrates were randomly moved adjacent the stream jet orifice under conditions of treatment set forth in the following table.

TABLE I

| | SUBSTRATE | AIR PRESS. PSI | AIR TEMP. °F. | DISTANCE FROM ORIFICE TO SUBSTRATE SURFACE |
|---|---|---|---|---|
| (1) | woven fabric containing laminated pile-like surface of polyethylene filamentary material | 1 | 400 | 0.1" |
| (2) | paper sheet containing laminated pile-like surface of polyethlyene filamentary material | 3 | 350 | 0.1" |
| (3) | needle-punched non-woven fabric of polypropylene filamentary material | 15 | 600 | 0.1" |
| (4) | tufted polypropylene | 6 | 600 | 0.1" |

TABLE I-continued

| SUBSTRATE | AIR PRESS. PSI | AIR TEMP. °F. | DISTANCE FROM ORIFICE TO SUBSTRATE SURFACE |
|---|---|---|---|
| pile yarn fabric | | | |
| (5) woven rayon plush pile fabric | 5 | 600 | 0.1" |
| (6) spun bonded nylon 66 fabric (1 oz/yd$^2$) | 6 | 600 | 0.1" |

Visual observation of the substrate treated under the conditions defined above indicated that narrow grooves were formed in the surface areas contacted by the heated air stream of substrates 1–5, with more precise definition of the grooves formed in the substrates 1–4 containing melt-spun type thermoplastic fibrous material than with non-thermoplastic type fibers, such as rayon (substrate 5), or with acrylic fibers, as in Example 6.

In substrate 6, above, the conditions of air stream treatment cut entirely through the substrate, indicating that the present invention can also be employed to produce lace effects in sheet material substrates and fabrics.

By use of the apparatus and methods of the present invention, it can be seen that surface modification of thermoplastic fiber and yarn containing textile fabrics, as well as other substrates, can be effected to impart precise, well defined and intricate patterns and surface appearances thereto. Fabric treatment may be carried out prior to dyeing to obtain subsequent differential dye uptake in the thermally modified and non-modified fibers and yarns, producing two-tone dye effects as well as surface patterning effects in the fabrics.

I claim:

1. A method for treating a moving substrate traveling in a well defined path by application of pressurized heated gas to the surface of said substrate to modify the surface appearance of said substrate and impart a visual pattern thereto, comprising the steps of:

(a) generating an elongate reservoir of uniformly heated pressurized gas extending across the path of said substrate;

(b) fixing the relative position of said substrate path in spaced but closely adjacent relation to said reservoir;

(c) forming, within said reservoir, a thin, elongate, precisely defined gas stream, said stream extending along the length of said reservoir;

(d) projecting said stream directly from said reservoir in the direction of said substrate surface;

(e) blocking, within said reservoir, a precisely defined portion of said elongate stream at at least one location along its length, thereby dividing said stream into at least two thin, precisely defined heated gas streams which collectively are spaced across the path of said substrate, which streams individually contact corresponding thin, precisely defined areas of said substrate surface, and thereby preventing other areas of said substrate surface opposite said blocked portion of said elongate stream from being contacted by said heated gas stream, said blocking being accomplished by directing a pressurized stream of cooler gas into the path of said elongate stream at said location;

(f) maintaining the temperature of said heated gas stream at a uniform level along the length of said reservoir, said level being sufficient to modify the surface appearance of said substrate; and (g) moving said substrate on said path and into said projecting streams from said reservoir.

2. The method of claim 1 wherein said heated pressurized gas is heated before entering said reservoir.

3. A method as defined in claim 1 wherein said substrate is a textile fabric.

4. A method as defined in claim 3 wherein said textile fabric is a nylon yarn-containing fabric and said nylon yarns contacted by said streams are thermally modified to produce a surface pattern effect therein.

5. The method of claim 1 wherein said blocking of said elongate stream at said at least one location is intermittent and for a predetermined duration, said duration being determined by pattern information continuously supplied at the same time said substrate is moving into said precisely defined streams.

6. The method of claim 1 wherein said blocking of said elongate stream occurs at at least three locations along the length of said elongate stream, and wherein said blocking is intermittent and for a predetermined duration, and wherein said blocking occurs simultaneously at a selected number of said locations, said duration and said selected locations determined by pattern information continuously supplied at the same time said substrate is moving into said precisely defined streams and being patterned thereby.

7. The method of claim 6 wherein said blocking occurs simultaneously over substantially the entire length of said elongate stream.

8. A method for treating a moving textile fabric traveling in a well defined path and containing thermally modifiable yarn components by application of pressurized heated gas to the surface of said fabric to modify the surface appearance of said fabric, comprising the steps of:

(a) generating an elongate reservoir of uniformly heated pressurized gas extending across the path of said substrate;

(b) fixing the relative position of said fabric path in spaced but closely and directly adjacent relation to said reservoir;

(c) forming, within said reservoir, a thin, elongate, precisely defined gas stream, said stream extending along the length of said reservoir;

(d) projecting said stream directly from said reservoir in the direction of said fabric surface;

(e) blocking, within said reservoir, a precisely defined portion of said elongate stream at at least one location along its length, thereby dividing said stream into at least two thin, precisely defined heated gas streams which collectively are spaced across the path of said fabric, which streams indiviually contact corresponding thin, precisely defined areas of said fabric surface and thermally modify yarn components contained therein, and thereby preventing other areas of said fabric surface opposite said blocked portion of said elongate stream from being contacted by said heated gas stream, said blocking being accomplished by positioning a solid obstruction having at least one opening therein within said reservoir and within the path of said elongate stream, thereby forming within said reservoir said heated gas streams, and by directing a pressurized stream of cooler gas into the path of one of said heated gas streams for the purpose of blocking within said reservoir, said one of said formed streams;

(f) maintaining the temperature of said elongate stream at a uniform level along its length, said level being sufficient to cause thermal modification of yarn components in the fabric contacted by said elongate stream extending across said fabric path; and (g) moving said fabric on said path and into said projecting streams from said reservoir.

9. The method of claim 8 wherein said heated gas streams are selectively blocked to impart a surface pattern effect which varies irregularly along the length of fabric movement.

10. A method as defined in claim 8 wherein said fabric is a polyester yarn-containing fabric and said polyester yarns contacted by said streams are longitudinally shrunk thereby.

11. A method as defined in claim 8 wherein said substrate is a pile fabric.

12. The method of claim 11 wherein said pile fabric contains thermoplastic pile yarns, and wherein the temperature and pressure of said heated fluid streams are maintained at a sufficient level to longitudinally shrink thermoplastic pile yarns contacted thereby.

13. A method as defined in claim 12 wherein the temperature of said heated gas is above the second order glass transition point of said thermoplastic pile yarns.

14. A method as defined in claim 8 wherein the temperature of said precisely defined heated gas streams are maintained at a sufficient level to cause longitudinal shrinking of said yarn components contacted thereby and pucker the fabric in areas of the fabric which have been prevented from being contacted by the heated gas stream.

15. The method of claim 14 wherein said textile fabric is woven, with said yarn components having generally uniform thermal shrinkage characteristics.

16. A method for treating a moving textile fabric traveling in a well defined path and containing a heat shrinkable yarn components by application of a pressurized heated gas to the surface of said fabric to modify the surface appearance of said fabric, comprising the steps of:

(a) generating an elongate reservoir of uniformly heated pressurized gas extending across the path of said substrate;

(b) fixing the relative position of said fabric path in spaced but closely and directly adjacent relation to said reservoir;

(c) forming, within said reservoir, a thin, elongate, precisely defined gas stream, said stream extending along the length of said reservoir;

(d) projecting said stream directly from said reservoir in the direction of said fabric surface;

(e) blocking, within said reservoir, a precisely defined portion of said elongate stream at at least one location along its length, thereby dividing said stream into at least two thin, precisely defined heated gas streams which collectively are spaced across the path of said fabric, which streams individually contact corresponding thin, precisely defined areas of said fabric surface and longitudinally shrink shrinkable yarn components therein, and thereby preventing other areas of said fabric surface opposite said blocked portion of said elongate stream from being contacted by said heated gas stream, said blocking being accomplished by directing a pressurized stream of cooler gas into the path of said elongate stream at each location along the length of said elongate stream wherein said portion of said elongate stream is to be blocked;

(f) maintaining the temperature of said heated gas stream at a uniform level along its length, said level being sufficient to cause shrinkage of yarn components in the fabric contacted by said elongate stream extending across said fabric path; and (g) moving said fabric on said path and into said projecting streams from said reservoir, the arrangement of said spaced gas streams and fabric movement forming a plurality of grooves on said fabric surface wherein yarn components forming edge-defining portions of said grooves are substantially unshrunken by said gas streams.

17. The method of claim 16 wherein said textile fabric comprises a fabric having a pile surface, and wherein said grooves are areas in which yarns are longitudinally shrunken into said pile surface, with yarns forming edge-defining portions of said grooves being substantially unshrunken by said heated gas and extending substantially perpendicular to said surface of said fabric.

18. The method of claim 16 wherein at least a portion of said grooves extends substantially parallel to said elongate stream.

19. The method of claim 16 wherein at least two of said grooves converge and meet in the direction of fabric travel.

20. The method of claim 16 wherein said grooves define closed boundaries completely surrounding areas wherein contact by said streams has been prevented.

* * * * *

UNITED STATES PATENT AND TRADEMARK OFFICE

CERTIFICATE OF CORRECTION

PATENT NO. : 4,499,637

DATED : February 19, 1985

INVENTOR(S) : John Michael Greenway

It is certified that error appears in the above-identified patent and that said Letters Patent is hereby corrected as shown below:

Column 2, line 21, the word "aparatus" should be "apparatus".

Column 2, line 41, the word "or" should be "of".

Column 6, line 56, the word "fronm" should be "from".

Column 7, line 35, the word "or" should be "of".

Signed and Sealed this

*Twenty-seventh* Day of *August 1985*

[SEAL]

*Attest:*

DONALD J. QUIGG

*Attesting Officer* *Acting Commissioner of Patents and Trademarks*